US005526326A

United States Patent [19]

Fekete et al.

[11] Patent Number: 5,526,326

[45] Date of Patent: Jun. 11, 1996

[54] SPEED INDICATING BALL

[75] Inventors: Ferenc Fekete, Wanchai; Kai Chung-Ho, Kowloon, both of Hong Kong; Norma Rosenhain, Castle Hills, Australia

[73] Assignee: Creata Inc., Wilmette, Ill.

[21] Appl. No.: 359,621

[22] Filed: Dec. 20, 1994

[51] Int. Cl.[6] ..... G04F 1/00

[52] U.S. Cl. ..... 368/10; 368/101; 273/55 R; 273/60 R

[58] Field of Search ..... 368/10, 107, 109, 368/101–106; 273/183.1, 58 G, 26 D; 377/5

[56] References Cited

U.S. PATENT DOCUMENTS 4,775,948 10/1988 Dial et al. ..... 368/250

5,163,014 11/1992 Calimeri ..... 368/2

FOREIGN PATENT DOCUMENTS 2190846 12/1987 United Kingdom .

*Primary Examiner*—Bernard Roskoski

*Attorney, Agent, or Firm*—Gifford, Krass, Groh, Sprinkle, Patmore, Anderson & Citkowski

[57] ABSTRACT

A speed indicating ball includes a timer, which is activated upon throwing of the ball, and deactivated upon catching of the ball, for measuring the ball's time of flight. The timer is connected to a display which provides a direct read out which is inversely proportional to the time of flight of the ball, and which corresponds to the relative velocity of the ball.

11 Claims, 5 Drawing Sheets

SPEED INDICATING BALL

FIELD OF THE INVENTION

This invention relates generally to balls which indicate the speed with which they are thrown. More particularly, the invention relates to a ball including a simple, but self contained, mechanical system for indicating the relative speed with which the ball is thrown.

BACKGROUND OF THE INVENTION

Ball players are often interested in knowing the speed with which a ball is thrown, both for training purposes and for simply enhancing the play value of a game. One approach to timing a thrown ball involves use of a Doppler Radar System in which the frequency shift of a radar beam reflected from a moving ball is processed to determine the ball's speed. Systems of this type are highly accurate, but they are expensive, technically sophisticated and usually must be operated by a person other than the ball player. Because of these factors, use of systems of this type are generally restricted to organized sport teams.

Doppler Radar Systems are usually not available to individual players, and accordingly, there is a need for a simple, self-contained system for indicating ball speed. One approach to the problem involves the placing of an electronic timer within the ball. The timer is operable to measure the ball's time of flight over a measured distance, and on that basis determines the ball's speed. This approach is detailed in U.S. Pat. No. 4,775,948 and in UK Patent Application No. 2,190,846. Systems of this type, while simpler than Doppler Radar measuring devices, are still fairly expensive. Also, they require the presence of a battery power source in the ball, and are somewhat difficult to operate. The U.S. Pat. No. 4,775,948 patent also describes a prior art mechanical system for indirectly determining a ball's speed. The described system is not self contained. It employs an internal timer for indicating the ball's time of flight and must be used in combination with a separate look-up table to determine the ball's speed. As is further noted in the U.S. Pat. No. 4,775,948 patent, the timer is unreliable, and the use of the look-up table complicates the utility of this approach.

It will be appreciated that a number of approaches to measuring a ball's speed have been implemented in the prior art, but such heretofore employed systems are complex, expensive and/or difficult to use and therefore of somewhat limited utility. The play value of a speed indicating ball is high and an item of this type would have a very large appeal to relatively young children; however, in order to be practical, any product oriented toward this market segment should be low in cost, rugged, self-contained and simple to operate. Therefore, it will be appreciated that there is a need for a speed indicating ball which is non electronic and which provides a direct readout of speed. An easy to manufacture, low cost item of this type will have significant utility as a promotional premium or mass-marketed toy.

The present invention provides a speed indicating ball which, as will be described in greater detail hereinbelow, is self-contained, non-electronic, and simple to manufacture and use. These and other advantages of the present invention will be readily apparent from the drawings, discussion and description which follow.

BRIEF DESCRIPTION OF THE INVENTION

Disclosed herein is a speed indicating ball, which includes a housing having a mechanical timer supported therein. The timer may be started at a first time and stopped at a second time so as to provide a mechanical output corresponding to an elapsed time interval between said first and said second times. The speed indicating ball further includes a winder in mechanical communication with the timer. The winder is operable by a user, for placing the timer in a wound state. The ball also includes an activator, for starting operation of the wound timer when the ball is released by the user, and a stop mechanism for stopping operation of the timer when the ball is caught. The ball includes a display in mechanical communication with the timer. The display is operative to receive the output of the timer and to display a speed signal which is inversely proportional to the elapsed time interval.

In one particular embodiment, the housing is a dual segment housing including a first portion and a second portion. The timer is supported in the first portion and is operable in a winding mode to store energy in a resilient member such as a spring, and in a timing mode to release the stored energy and rotate the output shaft thereby. In this embodiment, the second portion of the housing is in mechanical communication with the output shaft so as to be rotated thereby, relative to the first portion. This particular embodiment further includes a display comprising a series of indicia disposed upon one of the first or second portions of the housing, and an indexer associated with the other of said housing portions. The indexer operates to sequentially designate different members of the series of indicia as the housing portions rotate relative to one another. The designated indicia have numerical values which are inversely proportional to the time interval during which the output shaft is rotated.

In another embodiment, the speed indicating ball includes a mechanical timer supported in the housing. The timer is operable in a winding mode to store energy in a resilient member, such as a spring, and in a timing mode to release the stored energy and rotate an output shaft thereby so that the rotation of the shaft corresponds to an elapsed time interval. In this embodiment, the ball further includes a push button assembly in mechanical communication with the timer. As the push button assembly is urged into a first position, it operates the timer in the winding mode and stores energy in the resilient member. The push button assembly is further operable to disenable operation of the timer in the timing mode when it is maintained in said first position, and to enable entry of the timer into the timing mode when it is released from the first position. This embodiment further includes an inertially activated stop mechanism in mechanical communication with the timer for disenabling operation of the timer in the timing mode when the ball experiences a decelerating force. The ball further includes a display in mechanical communication with the output shaft of the timer for sequentially displaying members of a series of indicia. In specific embodiments, this particular ball includes an inertially activated stop mechanism which includes a resiliently mounted weight mechanically coupled to a stop arm, for stopping operation of the timer when the ball experiences a deceleration, and the push button assembly may be further operable to inhibit the operation of the stop mechanism during the initial portion of the timing cycle.

DETAILED DESCRIPTION OF THE INVENTION

The present invention concerns a ball which indicates the relative velocity in which it is thrown. The ball includes a timing mechanism having a mechanical timer which measures the time of flight of the ball, and operates a self contained, direct reading display device which displays a numerical output which is inversely proportional to the time of flight of the ball, and which thereby provides an indication of the relative speed in which the ball was thrown. The numerical value of the display can be appropriately selected so that a direct indication of approximate ball speed will be provided when the ball is thrown a specified distance, such as the distance from the pitcher's mound to home plate of a baseball field.

Figure 1:
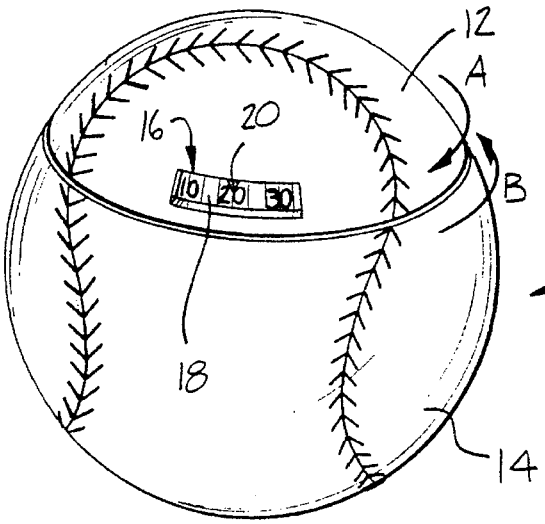
FIG. 1 is a perspective view of one embodiment of a speed indicating ball structured in accordance with the principals of the present invention.

Referring to FIG. 1, there is shown a perspective view of one embodiment of a ball 10, structured in accordance with the present invention. The ball 10 of FIG. 1 is configured as a baseball and includes a housing comprised of first portion 12 and a second portion 14 which, as will be described in greater detail hereinbelow, may be rotated relative to one another, as indicated by arrows A and B. The ball 10 includes a display 16 associated therewith. The display includes a series of numerical indicia 18 and indexer, which in this instance comprises a pointer 20, for designating particular ones of the series of indicia 18.

Figure 2A:
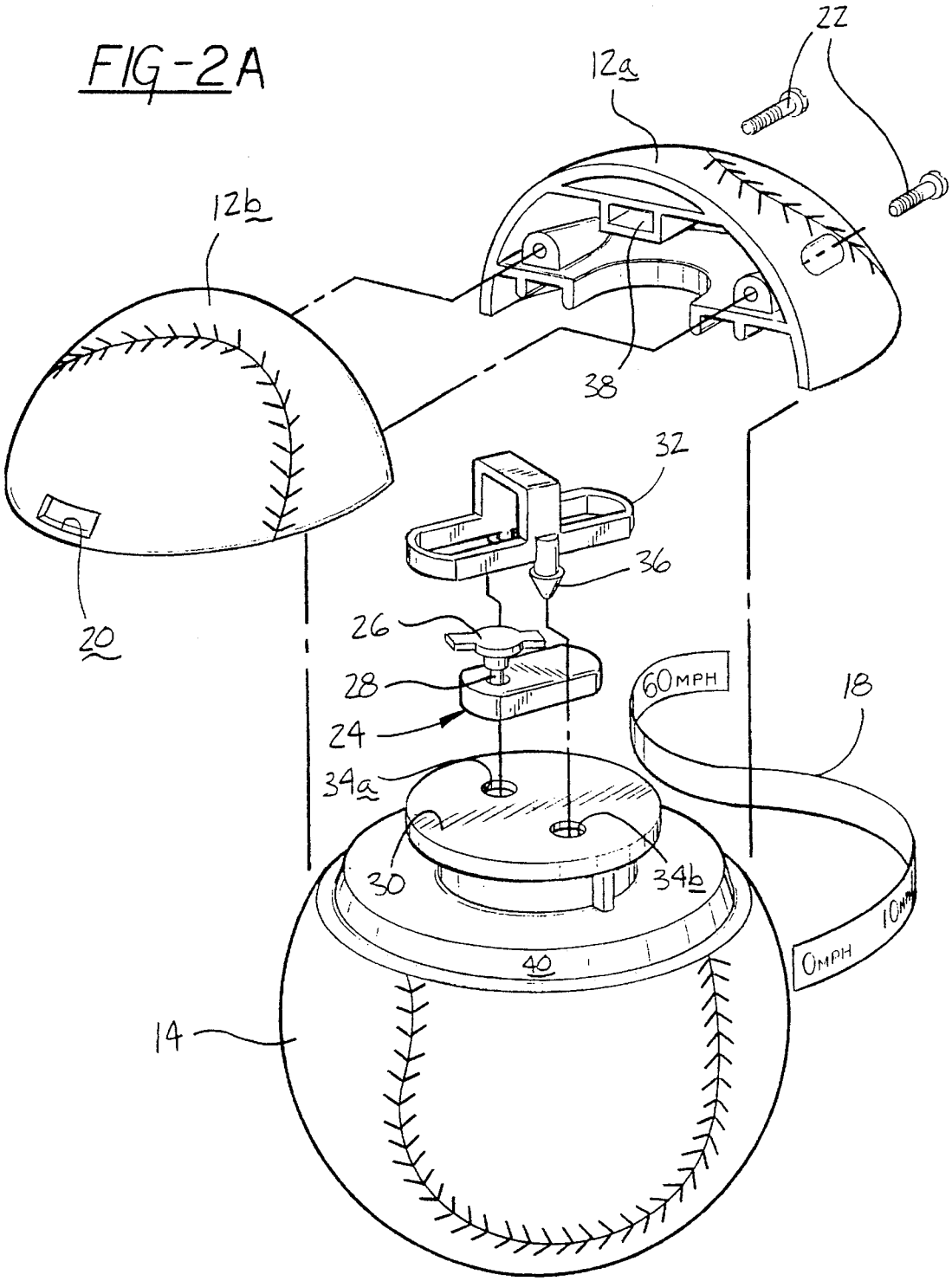
FIG. 2A is an exploded view of the ball of FIG. 1.

Referring now to FIG. 2A, there is shown an exploded, perspective view of the ball 10 of FIG. 1. As noted, the ball includes a two-part housing having a first portion 12, and this particular embodiment is fabricated from two sub-portions 12*a* and 12*b* joined together by screws 22. The housing further includes a second portion 14. The ball of FIG. 2A includes a mechanical timer 24 of the type well known in the art. The timer 24 includes a winding knob 26 coupled to an input/output shaft 28, and also includes a spring, or other such resilient energy storage member. As is known in the art, rotation of the winding knob 26 and the associated shaft 28, places the spring of the timer 24 under tension, thereby winding the timer and storing energy. When the winding knob 26 is released, the timer enters the timing mode releasing stored energy and rotating the shaft 28. As is known in the art, the timer 24 includes gearing and/or an escape mechanism for controlling the release of energy so as to provide a relatively constant shaft output.

The ball of FIG. 2A includes a support platform 30 associated with the second portion 14 of the housing, for supporting the timer 24 thereupon. The ball of FIG. 2A further includes a retainer 32 for affixing the timer 24 to the support platform 30, and toward that end, the support platform 30 includes a pair of openings 34*a* and 34*b* defined therein. These openings are configured to receive and retain mounting lugs associated with the retainer 32, and in FIG. 2A, one of these lugs 36 is visible. It is to be understood that other mounting arrangements may be similarly employed.

The first portion 12 of the housing is configured to engage the winding knob 26 of the timer, and toward that end includes an engagement portion 38 molded therein. In this matter, the timer may be wound by rotation of the two portions 12, 14 of the ball relative to one another in a first direction, and in turn operation of the timer will cause the portions 12, 14 to undergo relative rotation in a second direction, opposite said first direction. As illustrated, the ball further includes a label 18 having a series of indicia thereupon. The label 18 is affixed to a region 40 of the second portion 14 of the housing, although it is to be understood that, in some embodiments, the indicia may be directly molded onto the portion 40 of the housing. The first portion of the housing includes an indexer, which in this instance comprises a window with a pointer 20 formed in a segment 12*b* of the first portion 12 of the housing. It will be understood that as the two portions 12, 14 rotate relative to one another, indicia on the label 18 will be sequentially displayed. The spacing and valuation of the indicia on the label will be selected so that the numerical values thereof will be inversely proportional to the time during which the shaft is rotating; that is to say, if the shaft is only rotated for a short period of time, the value of the displayed indicium will be high, whereas the value will be proportionately lower after the shaft has rotated for a longer period of time.

In use, a player winds the timer by rotating the two portions 12, 14 of the housing relative to one another. Rotation is carried out until a preselected start indicium is displayed by the ball. This indicium may comprise a specified high speed value, or a specifically designated start point. When the player is gripping the ball, his or her hand will prevent the housing portions from rotating, thereby maintaining the wound timer in a ready, but non-running state. When the ball is thrown, the two housing portions 12, 14 will begin to rotate relative to one another displaying a decrementing speed signal. When the ball is caught, the player's hand will stop the relative rotation of the two housing portions, thereby stopping the timer. The speed with which the ball was thrown can then be read from the display.

The mechanism of the present invention is simple, low in cost, easy to use and will provide a relatively accurate indication of the relative speed with which the ball is thrown; hence, it is particularly suitable as a promotional premium or as a low cost toy for children. The ball's speed in inversely proportional to its time of flight, and the display may be calibrated to give a direct speed reading for a standard distance. The ball may be made to provide a direct reading for any of a plurality of specified distances by selecting the start point of the display.

Figure 2B:
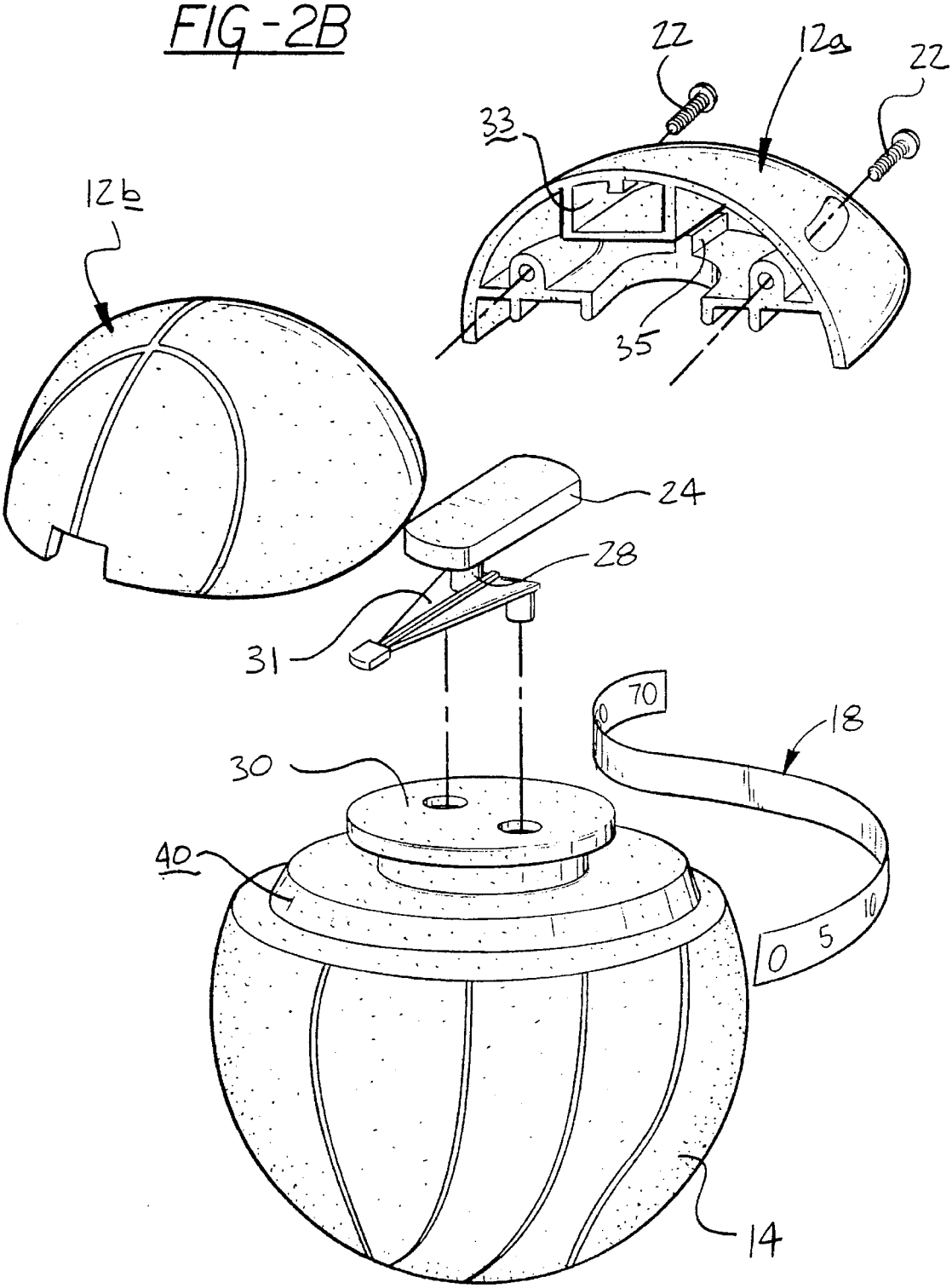
FIG. 2B is an exploded view of another embodiment of all generally similar to that of FIG. 2A.

Referring now to FIG. 2B, there is shown another embodiment of speed indicating ball generally similar to that of FIG. 2A, and like elements will be referred to by the same reference numerals. The FIG. 2B embodiment differs from that of FIG. 2A with regard to the mounting and configuration of the timing mechanism.

The FIG. 2B embodiment includes a housing having a first portion formed from two sub-portions 12*a* and 12*b* joined together by screws 22, and a second portion 14 generally as previously described. The FIG. 2B embodiment includes a windup timer 24 having an input/output shaft 28. As in the previous embodiment, the timer 24 may be wound by turning the shaft 28, and when operating, the timer causes the shaft 28 to rotate. In the FIG. 2B embodiment, the shaft 28 of the timer 24 is coupled to a stop arm 31, which in turn is affixed to the support platform 30 of the second portion 14 of the housing. The sub-portion 12*a* of the first portion of the housing is configured to provide a pocket 33 which receives and retains the body of the timer 24. In this manner, the timer may be wound by rotating the two portions 12, 14 of the housing relative to one another; conversely, as the timer unwinds, rotation of the shaft 28 will cause the housing portions to rotate, just as in the FIG. 2A embodiment. The stop arm 31 moves with the second housing portion 14, and relative to the first housing portions 12*a*, 12*b* as the timer shaft 28 rotates. The stop arm includes a tab portion which is configured and disposed so as to strike a corresponding stop ridge, for example ridge 35 associated with housing portion 12*a*. The stop ridge 35 prevents the stop arm 31 from traveling therepast, and it will appreciated that the cooperation of the ridge 35 and arm 31 limits rotation of the shaft 28 to slightly less than one full rotation. In this manner, stop and start points are automatically determined. A user may thus simply wind the two halves of the housing to the stop point and throw the ball. Rotation of the two housing will proceed as previously described.

Figure 3:
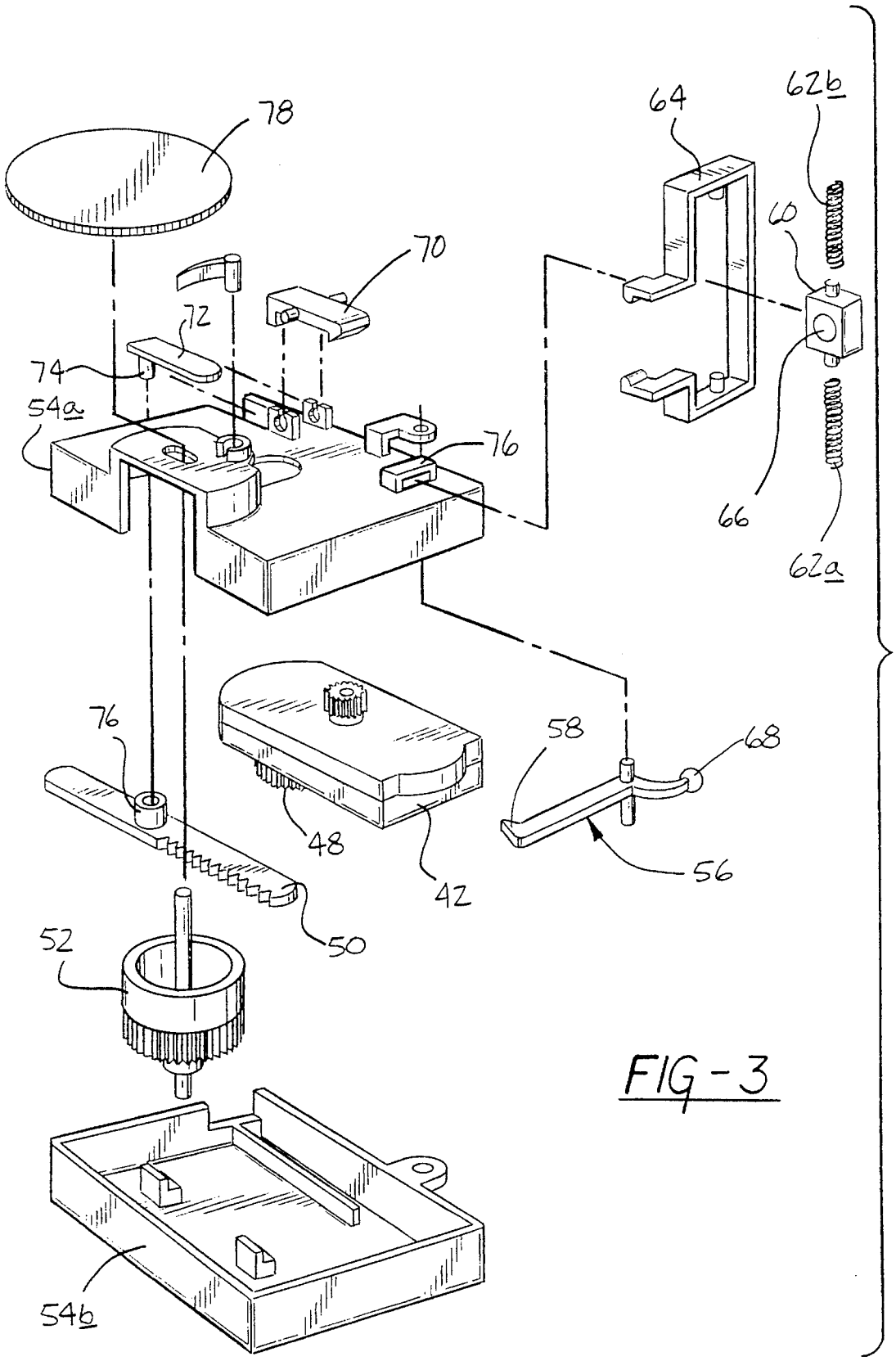
FIG. 3 is an exploded view of a timing mechanism of a speed indicating ball of the present invention.

Within the context of the present invention, speed indicating mechanisms other than those shown in FIGS. 2A and 2B may also be employed. For example, FIG. 3 shows an exploded, perspective view of another embodiment of speed measuring mechanism structured in accordance with the present invention. Specifically shown therein is a timer/indicator mechanism of the type which may be supported within a ball shaped housing. The FIG. 3 embodiment includes a timer 42. The timer 42 is generally similar to those timers previously described insofar as it is operable in a winding mode to store energy in a spring or other such resilient member, and it is operable in a timing mode, to release the stored energy so as to rotate an output shaft 44, and associated pinion gear 46 thereby. The timer 42 includes an input shaft for winding the spring and this input shaft is separate from the output shaft 44, and includes a winding gear 48 associated therewith.

The FIG. 3 mechanism includes a push button assembly for winding and activating the timer. The push button is not illustrated in FIG. 3, but is disposed on the outside of the ball and communicates with a rack gear 50, which in turn engages the winding gear 48. When the push button is depressed, it advances the rack gear 50 so as to wind the timer 42. If the push button is retained in a depressed position, it prevents the wound timer from entering the timing mode. When the push button is then released, the timer is then free to enter the timing mode, and the output shaft 44 and associated pinion gear 46 begin to rotate. The rotation thereof drives a speed indicating dial 52 in a manner analogous to the operation of the FIG. 2 embodiment. In the FIG. 3 embodiment, the various components are disposed in, and supported on, a casing which as shown herein is comprised of a first portion 54*a* and second portion 54*b*.

The FIG. 3 embodiment further includes an inertially activated stop mechanism for disenabling operation of the timer when the ball experiences a decelerating force. The stop mechanism includes a stop arm 56 which is pivotably supported on the casing and which includes a pawl 58 which is capable of engaging the pinion 46 and halting operation of the timer 42. The stop mechanism further includes a floating hammer 60 which is resiliently supported in a frame 64 by a pair of coil springs 62*a*, 62*b*. The floating hammer is free to move within the frame 64 and includes a socket 66 which engages a ball portion 68 of the stop arm 56. When the ball experiences a decelerating force, the floating hammer 60 continues to move and causes the stop arm 56 to pivot so that the pawl 58 engages the pinion 46 thereby halting the timer.

It is possible that the acceleration experienced by the ball when it is thrown might cause the inertially activated mechanism to stop the timer prematurely. For this reason, FIG. 3 embodiment is operative to lock out the stop mechanism at the beginning of the timing cycle. Toward this end, the mechanism includes a hook 70 pivotably supported on the upper portion 54*a* of the case. The hook in turn is engageable by a push pin 72 which is supported upon the rack gear 50 by means of a shaft 74 which engages a corresponding socket 76 on the rack gear 50. When the rack gear is advanced to wind the timer 42, the push pin 72 engages the hook 70 which coacts with a stop member 76 formed upon the upper casing 54*a* and immobilizes the stop arm 56, preventing it from pivoting and stopping operation of the timer 42. As the timer runs, the push pin 72 is withdrawn, thereby freeing the hook 70 to move about its pivot axis which, in turn, frees the stop arm 56 to be moved by the floating hammer 60. It should also be noted that the hook 70 and stop member 76 coact, when urged by the push pin 72, to move the stop arm so that the pawl 58 disengages the pinion 46, thereby resetting the stop mechanism.

In the FIG. 3 embodiment, the speed is indicated by a dial 52 having a series of indicia disposed thereupon, which are displayed through a portion of the housing of the ball. The dial 52 includes a geared portion 53 which is driven by the pinion 46, and which is biased into engagement therewith by a spring 55. In the illustrated embodiment, a turning wheel 78 is mechanically coupled to the speed indicator 52. The turning wheel 78 is used to manually adjust the start point of the speed indicator, and is disposed so that pressure thereupon overcomes the force of the spring 55, permitting the dial 52 to be rotated independently of the pinion 46.

Figure 4:
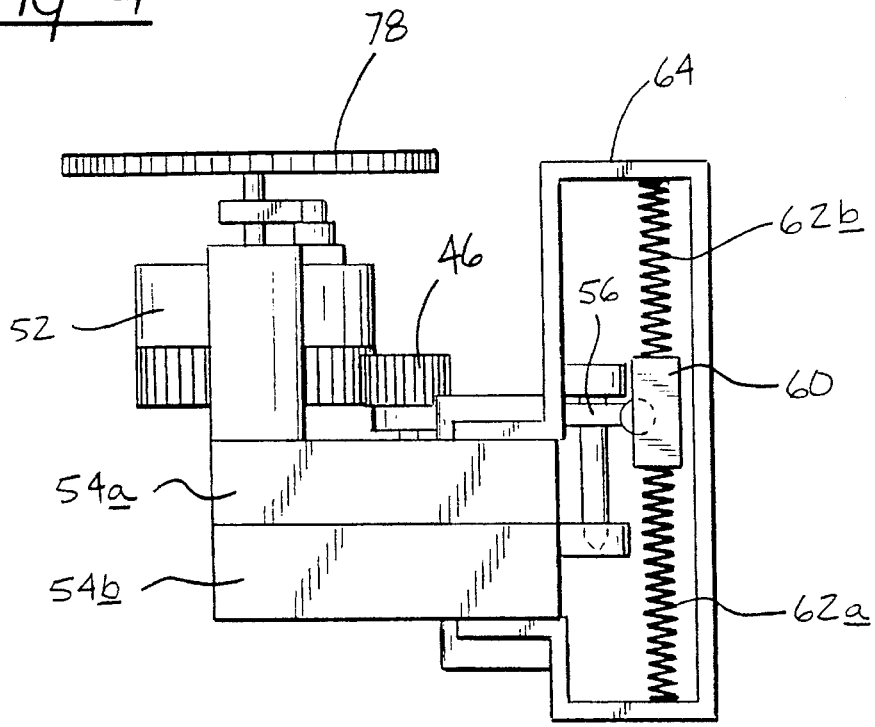
FIG. 4 is a side elevational view of the timing mechanism of FIG. 3.

Referring now to FIG. 4 there is shown a side elevational view of the mechanism of FIG. 3 particularly illustrating the manner in which the frame 64 supports the springs 62*a*, 62*b* and floating hammer 60. Also visible in the FIG. 4 drawing are a portion of the stop arm 56, the pinion 46, the speed indicator 52, the turning wheel 78, and the casing 54*a*, 54*b*.

Figure 5:
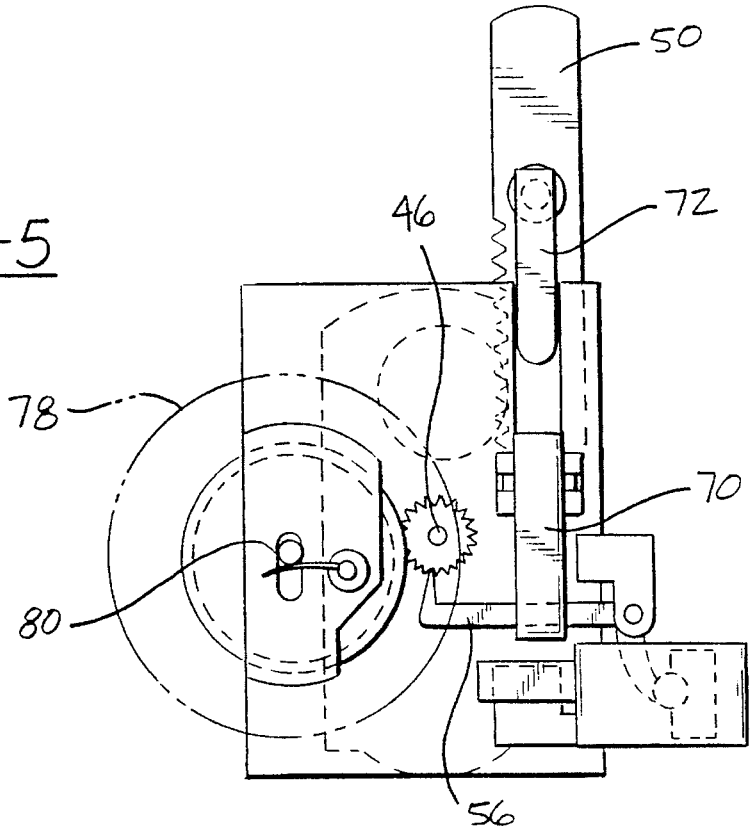
FIG. 5 is a top plan view of the timing mechanism of FIG. 3.

FIG. 5 is a top plan view of the mechanism of FIG. 3, particularly illustrating the cooperation of the push pin 72, hook 70 and rack gear 50 to lock and unlock the stop arm 56. The figure also shows a turning wheel 78 in phantom, and a spring 80 which maintains the speed indicator 52 in engagement with the pinion. When the turning wheel 78 is adjusted, finger pressure urges the speed indicator 52 out of engagement with the pinion against the bias of the spring 80, permitting adjustment of the initial set point. It will be appreciated that in some embodiments, the turning wheel 78 may comprise the display device itself, and toward that end may include indicia thereupon; in such instance, the turning wheel will be appropriately placed on the outside of the housing.

In the operation of the FIG. 3–5 embodiment, the user first pushes in a push button disposed on the surface of the ball to thereby push the rack gear 50, wind the timer 42 and lock out the inertial stop mechanism. The user maintains the push button in a pushed condition, thereby preventing the timer from beginning operation. The user then adjusts the turning wheel 78, if necessary, to set the timer display 52 to an appropriate position. The user then throws the ball, thereby releasing the push button and permitting the timer to begin operation. As the timer runs, the rack gear 50 runs back towards its initial position, and after a relatively short period, the moving rack gear withdraws the push pin 72 from the hook 70, thereby unlocking the inertial stop mechanism. When the ball is caught, the floating hammer 60 moves the stop arm 56 so as to lock the pinion gear 46, thereby halting the timer 52.

Figure 6:
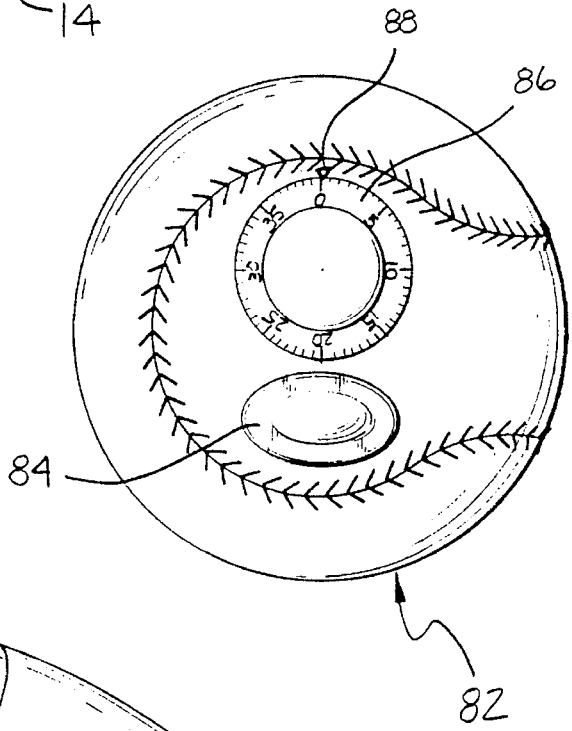
FIG. 6 is an external view of another embodiment of a speed indicating ball of the present invention including a timing mechanism generally similar to that in FIGS. 3–5.

The present invention may be implemented with mechanical systems other than those shown herein. For example, the display associated with the FIGS. 3–5 embodiment may be implemented in a manner similar to that of FIG. 1, by directly coupling a portion of a ball shaped housing to the rotating output shaft of the timer. Referring now to FIG. 6, there is shown yet another embodiment of a speed indicating ball structured in accordance with the present invention. The FIG. 6 embodiment comprises a ball 82 having a mechanical system generally similar to that shown in FIG. 3–5, and toward that end, the ball 82 includes a push button 84 as previously described. The display on the ball 82 is comprised of a turning wheel 78 which operates in combination with an indexing pointer 88 on the surface of the ball 82. As in the previous embodiments, the start point of the display may be manually set by including a slip clutch or spring arrangement, to permit the wheel 78 to be manually turned prior to timing.

Figure 7:
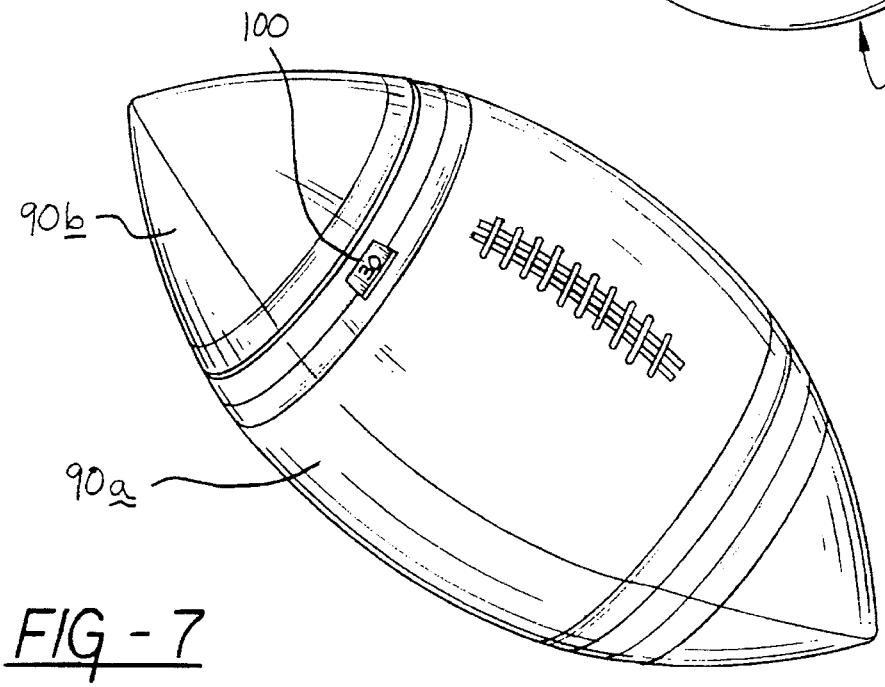
FIG. 7 is an external view of another embodiment of a speed indicating ball configured as a football.

Other configurations of the ball may be implemented in accord with the present invention. FIG. 7 depicts a speed indicating football manufactured in accord with the principals of the present invention. The FIG. 7 ball is mechanically structured in accord with the FIG. 2A or FIG. 2B embodiment and includes a housing comprised of a first portion 90*a* and a second portion 90*b*, and a display 100 as generally described with reference to the FIG. 3 embodiment. In yet other embodiments, the ball may be configured as a soccer ball, or it may be ornamented with raised relief features representative of cartoon or storybook characters.

The foregoing drawings, discussion, and description are meant to illustrate particular embodiments of the invention and are not meant to be limitations on the practice thereof. It is the following claims, including all equivalents, which define the scope of the invention.

We claim:

1. A speed indicating ball comprising:

a housing: including a first portions and second portion;

a mechanical timer which is supported by the first portion of said housing and enclosed within said housing, and which may be started at a first time and stopped at a second time so as to provide a mechanical output corresponding to an elapsed time interval between said first time and said second time, said mechanical output comprising the rotation of a shaft which is coupled to said timer and to the second portion of the housing so that said first and second portions rotate relative to one another during said elapsed time interval;

a winder which is in mechanical communication with said timer and is operable by a user for placing the timer in a wound state;

an activator for starting operation of the timer when the timer is in the wound state and the ball is released by the user;

a stop mechanism for stopping operation of the timer when the ball is caught;

a display which is in mechanical communication with the timer and is operative to receive the output thereof and to display a speed signal which is inversely proportional to said elapsed time interval.

2. A ball as in claim 1, wherein said display comprises:

a series of indicia supported on one of said first and second portions of the housing;

an indexer associated with the other of said first and second portions of the housing, for sequentially designating different members of said series of indicia as said housing portions rotate relative to one another.

3. A ball as in claim 1, wherein said winder is comprised of said second portion of the housing and wherein said timer is placed in said wound state by rotating said first and second housing portions relative to one another in a second direction, opposite said first direction.

4. A ball as in claim 3, wherein said activator is comprised of said first and second housing portions, which portions are configured to be grasped by a hand of the user so as to prevent relative rotation thereof.

5. A ball as in claim 1, wherein the display includes a dial which is in mechanical communication with, and rotated by, the shaft and which bears a series of indicia thereupon.

6. A ball as in claim 1, wherein said timer includes an operating spring and wherein the winder includes a push button which is mechanically connected to the spring and which operates to put the spring under tension so as to place the timer in the wound state when depressed from a first position to a second position.

7. A ball as in claim 6, wherein said push button further comprises said activator and is further operable, when released from said second position, to be urged back towards said first position by said spring so that the push button releases tension from said spring, and enables operation of said timer.

8. A ball as in claim 1, wherein said stop mechanism is an inertially activated mechanism including a resiliently mounted weight mechanically coupled to a stop arm for stopping operation of the timer when the weight experiences a deceleration.

9. A speed indicating ball comprising:

a housing;

a timer which is supported by, and enclosed within, said housing, said timer being operable in a winding mode to store energy in a resilient member, and in a timing mode to release stored energy so as to rotate an output shaft thereby, the rotation of said output shaft corresponding to an elapsed time interval;

a push button assembly in mechanical communication with the timer for operating the timer in the winding mode and storing energy in the resilient member as said push button assembly is urged into a first position, said push button assembly being further operable to disable operation of the timer in the timing mode when the push button assembly is maintained in said first position and to enable the entry of the timer into the timing mode when the push button assembly is released from the said first position;

an inertially activated stop mechanism in mechanical communication with the timer for disabling operation of the timer in the timing mode when the ball experiences a decelerating force;

a display in mechanical communication with the output shaft of the timer for sequentially displaying members of a series of indicia.

10. A ball as in claim 9, wherein said push button assembly is further operable, when urged into said first position, to lock the inertially activated stop mechanism.

11. A speed indicating ball comprising:

a housing including a first and a second housing portion, said housing portions cooperating to define an exterior surface configured to resemble a ball and to enclose an interior volume, said first housing portion including a pocket defined therein, said pocket being in communication with said interior volume, and said second housing portion including a support platform defined thereupon and in communication with said interior volume;

a mechanical timer including a body portion having a spring retained therein and an input/output shaft projecting from said body portion and in mechanical communication with the spring, said input/output shaft being operative in an energy storage mode to deliver mechanical energy to said spring, and being further operative in an output mode to receive mechanical energy from said spring so as to be rotated thereby, the body portion of said timer being retained in the pocket of said first housing portion;

a stop-arm which is mechanically coupled to the input/output shaft so as to rotate therewith, said stop arm being affixed to the support platform of the second housing portion so as to mechanically couple said housing portions together through said input/output shaft so that the housing portions rotate relative to one another as said input/output shaft rotates, said stop-arm further including a tab portion projecting therefrom, said tab portion disposed so as to strike a stop ridge which is associated with one of said first and second housing portions, said tab and stop ridge cooperating to restrict the extent to which said housing portions are free to rotate relative to one another;

a display comprising a series of indicia supported on one of said first and second housing portions, and an indexer associated with the other of said first and second housing portions for sequentially designating members of said series of indicia as said housing portions rotate relative to one another.

* * * * *